US005409149A

United States Patent [19]

Hough

[11] Patent Number: 5,409,149

[45] Date of Patent: Apr. 25, 1995

[54] MIXER HOUSING GATE ASSEMBLY

[75] Inventor: Richard M. Hough, Lansing, Mich.

[73] Assignee: Hough International, Inc., Albertville, Ala.

[21] Appl. No.: 184,463

[22] Filed: Jan. 19, 1994

[51] Int. Cl.[6] ..... B65D 47/00

[52] U.S. Cl. ..... 222/503; 222/504; 49/118; 49/122; 49/340; 105/286; 105/289; 251/56; 251/212; 251/203

[58] Field of Search ..... 222/503, 504, 557, 502, 222/506; 251/56, 212, 279, 203, 280; 105/286, 280, 288-290; 49/118, 122, 340

[56] References Cited

U.S. PATENT DOCUMENTS

| | | | |
|---|---|---|---|
| 1,714,182 | 5/1929 | McNulty | 251/280 |
| 2,069,739 | 2/1937 | Fildes et al. | 222/503 |
| 2,070,152 | 2/1937 | Bennett | 222/503 X |
| 2,785,840 | 3/1957 | Nave | 251/280 X |
| 4,043,491 | 8/1977 | Johnson et al. | 222/503 |
| 4,280,681 | 7/1981 | Harris | 251/56 X |
| 4,844,292 | 7/1989 | Lonardi et al. | 222/503 |
| 5,241,989 | 9/1993 | Kalavitis | 251/212 X |

OTHER PUBLICATIONS

Hough Brothers Inc. Drawing—Mixer Section and Door Detail, Feb. 9, 1979.

*Primary Examiner*—Gregory L. Huson

*Attorney, Agent, or Firm*—Price, Heneveld, Cooper, DeWitt & Litton

[57] ABSTRACT

A dump gate assembly as for a feed mixer housing including first and second hinged gates swingable between upper closed condition and lower open condition, each gate having a cam track preferably in the form of a configurated gate stiffener cooperable with a cam follower on an actuator. The cam tracks have a portion causing greater force to be applied to the gates during the final movement of the gates to the closed condition. The actuators for the two respective gates are at opposite ends of the gates and are interconnected to cause timed gate closing. A special seal element causes a second seal between the closed gates.

21 Claims, 6 Drawing Sheets

MIXER HOUSING GATE ASSEMBLY

BACKGROUND OF THE INVENTION

This invention relates to a drop gate for a particulate material tub or trough, and more particularly to a drop gate for a mixer as for animal feed.

Mixing of particulate material such as animal feed is conventionally performed as in a rotating ribbon mixer having an elongated housing tub or trough. At the curved bottom of the tub is a pair of hinged arcuate swing gates which swing downwardly open and away from each other on hinges along the outer edges of the gates, and along the edges of an opening, somewhat similar to bomb bay doors on an airplane. One of the gates typically has an elongated batten strip protruding from and extending along the inner edge of the gate, to underlie and overlap the juncture between the two arcuate gates when closed. The gates are conventionally closed by pivotal links and attached turnbuckles which are shifted upwardly in a compressive movement of the links and turnbuckles to close the gates. Such a prior art structure (see FIG. 11) has certain problems. One problem is the tendency for the gates not to close completely, often due to some of the feed material being caught between the adjacent, inner edges of the gates, and also between the batten strip and the adjacent gate. This can result in excess stress being applied to the turnbuckles when the gates are closed, too often causing the turnbuckles to bend or be otherwise damaged. This also results in the gates not closing tightly thereafter, i.e., at future operation thereof. Related to this problem is the tendency for the particulate material to get wedged not only between the two gates as noted above, but also between the outer edge of each gate and the edge of the adjoining tub on which the gate is hingedly mounted. For these and other reasons, the gates soon begin to leak material prior to dumping.

Another problem of the conventional structure is the tendency for the two gates to close out of synchronism such that the gate with the batten strip might close first and prevent the other gate from properly closing. Additional problems involve difficulty of replacement of the hinges when the hinge components become worn.

SUMMARY OF THE INVENTION

An object of this invention is to provide an improved drop gate assembly for a housing, as of a mixer tub or trough, for controllably dumping particulate material such as feed from the housing. The gates are each operated by a roller cam follower on a pivot arm, the cam followers following special cam tracks on the gates. The cam tracks preferably comprise shaped gate stiffeners which are preferably configurated to cause increased force to be applied to the gates as they approach and reach the fully closed position. Actuators for these gates are located on opposite ends of the respective elongated gates. Shafts connecting the pivot arms for the cam followers are interconnected to the closing mechanisms at both ends, to thereby cause their movement in timed relationship. The rollers move past center a few degrees upon complete closing, to maintain full closure of the gates.

The gates have beveled inner and outer edges, the inner edges of both gates cooperating to squeeze any remaining particulate material from between the closing gates, while the outer edges of both gates squeeze particulate material from between these edges and the adjacent edges of the housing opening.

One of the gates has an overlapping metal batten which supports and forms a first seal with the other overlapped gate and also engages and cooperates with a rubber gasket specially retained along the edge of the other gate to form a second seal at the base of the trough housing.

These and other objects, advantages and features of the invention will become apparent upon studying the following disclosure in conjunction with the drawings.

DESCRIPTION OF THE PREFERRED EMBODIMENT

Figure 1:
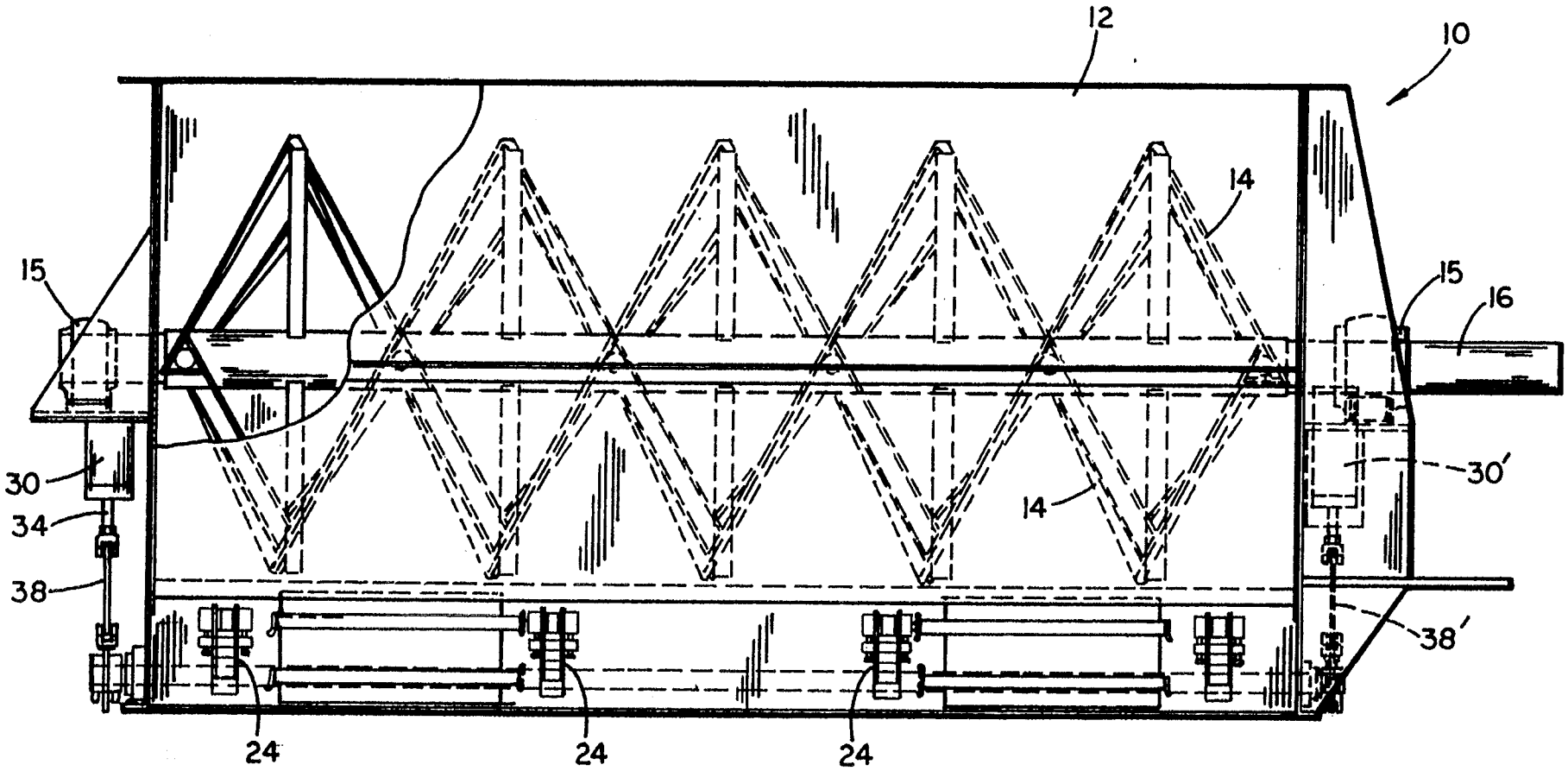
FIG. 1 is a side elevational view of a Mixer employing this invention.

Referring specifically to the drawings, the invention is disclosed relative to its preferred embodiment in a combination particulate material mixer as for animal feed. Specifically, there is depicted a generally U-shaped, open top, axially elongated trough or tub 12 which has a pair of end plates 13, and a helical mixer blade subassembly 14 mounted on a rotational drive shaft 16 extending through the ends of the tub. The shaft is supported on a pair of pillar block bearings 15 and driven by a power source, e.g., an electric or hydraulic motor (not shown). The tub 12 has a semicylindrical bottom to cause the rotating helical mixer blades 14 to move closely adjacent the tub bottom. The very bottom portion of this tub bottom is composed of two swing gates 20 and 20' which have the same arcuate curvature as the adjacent portions of the tub bottom so as to form a part of the tub when mixing occurs. These gates are swingable, i.e., pivotable, on a pair of spaced, outside, parallel hinges 22 and 22' between an upper, closed position cooperative with each other to a lower open position away from each other, for dumping the contents from the mixing tub.

Each of these gates 20, 20' has a plurality of stiffening ribs 24, 24' respectively along the underside thereof, at spaced intervals, each extending generally transversely relative to the axis of the elongated assembly. At least one, and preferably all, of these stiffening ribs is specially configurated to also function as a configurated cam track. This cam track includes a first portion closest to hinges 22 and 22' and configurated with an arcuate convex curvature generally comparable to that of the gate. Each of these cam tracks also includes a second portion closer to the lower edges of the gates, configurated to cause greater closing force to be applied to the gates as they approach the closed condition, as will be explained more fully hereinafter. This second portion of the curved cam track is shown to have a concave curvature which also enables the driving mechanism to be put into a slightly over center condition for holding the gates closed, as will be explained more fully hereinafter.

Figure 2:
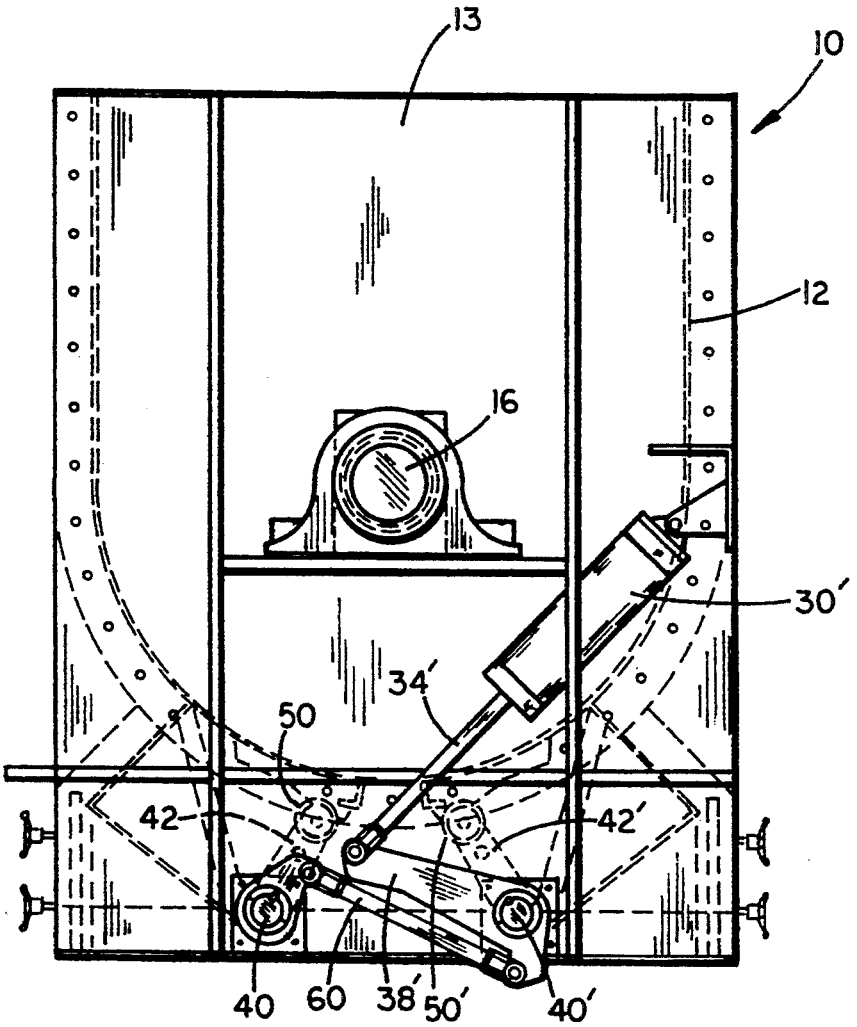
FIG. 2 is an end elevational view of the mixer in FIG. 1.
Figure 6:
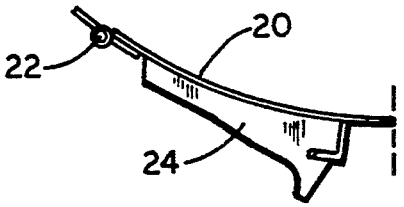
FIG. 6 is a fragmentary, end elevational view of one of the gates and its cam track of this invention.
Figure 3:
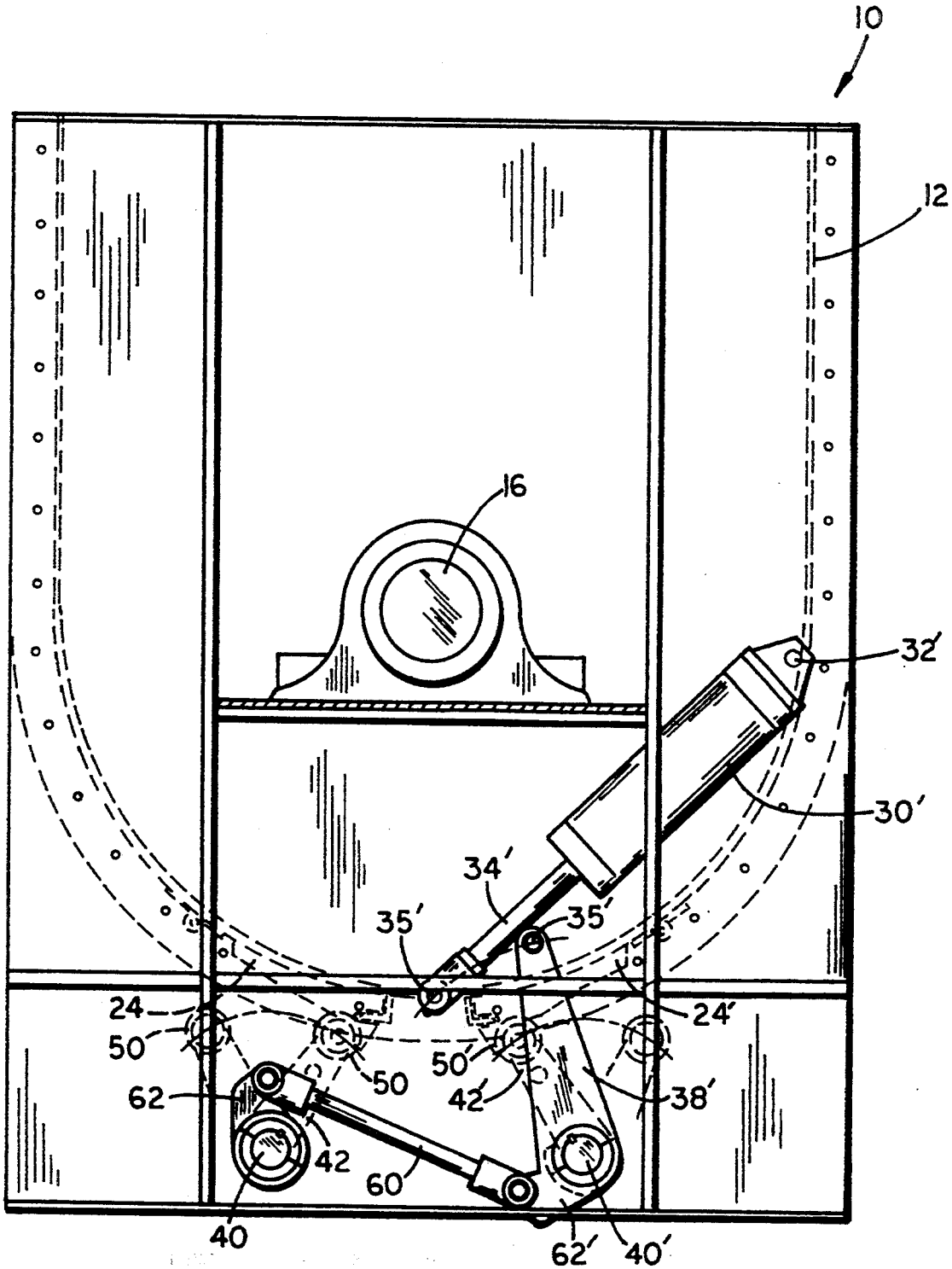
FIG. 3 is a somewhat enlarged, partial, end elevational view of the mixer apparatus in FIG. 2, showing the gate actuator mechanism in more detail.
Figure 4:
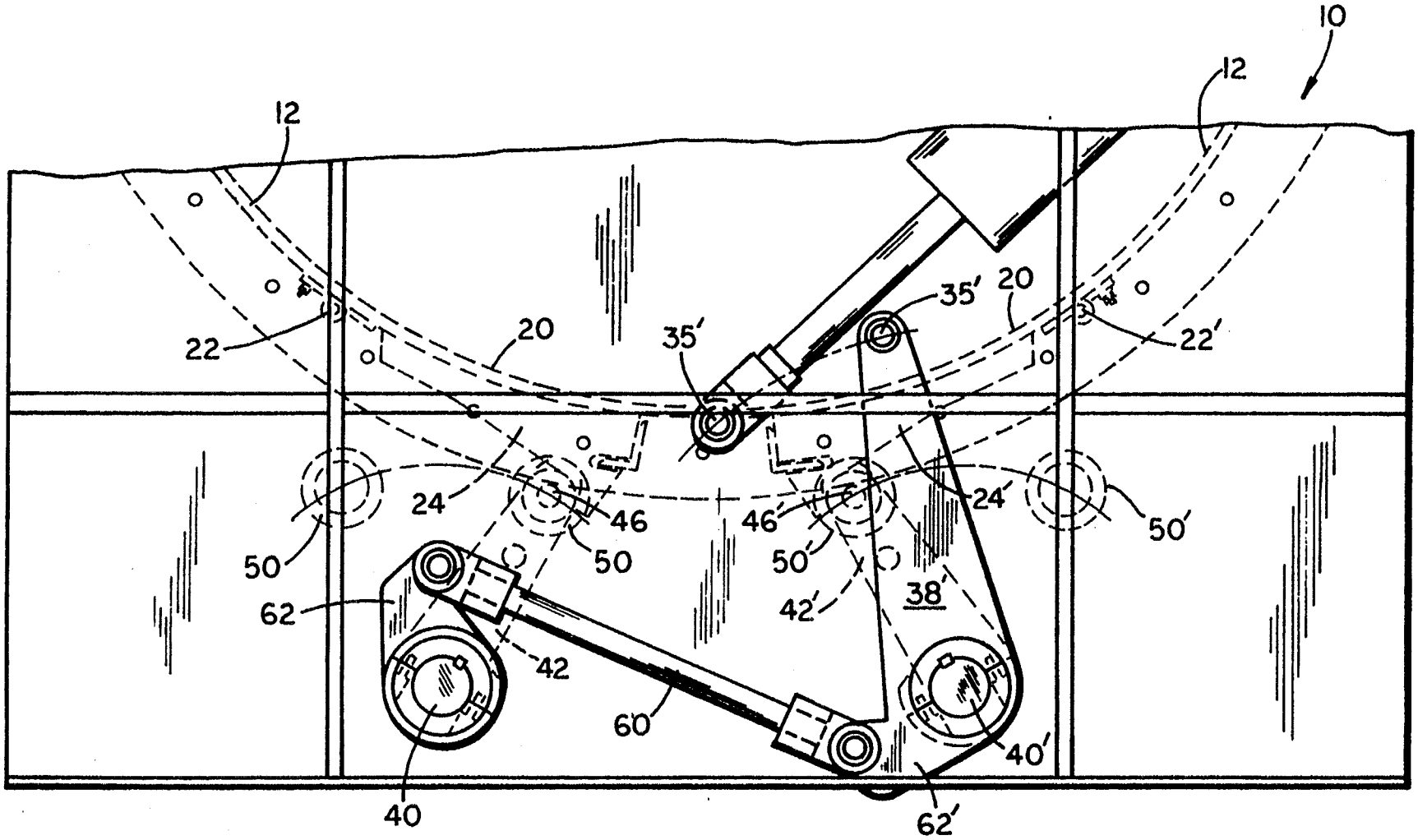
FIG. 4 is a substantially enlarged, fragmentary, end elevational view of the apparatus in FIGS. 2 and 3.
Figure 7:
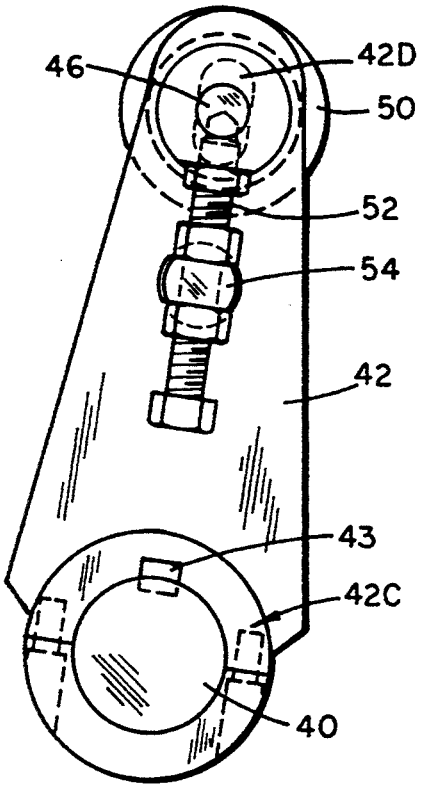
FIG. 7 is an enlarged, end elevational view of one of the cam follower rollers and its roller arm.
Figure 8:
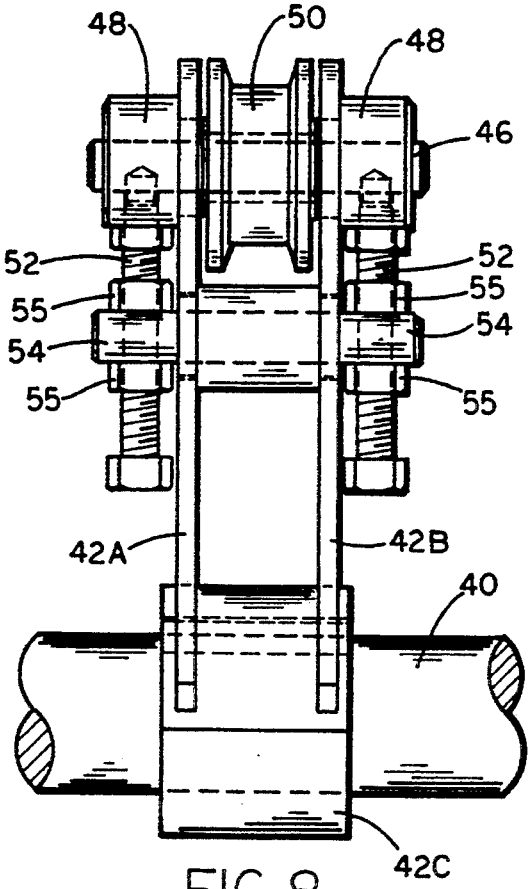
FIG. 8 is a side elevational view of the apparatus in FIG. 7.

Each of these gates is shown to have an actuator for opening and closing the gates, depicted as fluid cylinders 30 and 30' respectively. Each of these fluid cylinders has its outer cylinder end pivotally attached to a pivot pin, see, e.g., pin 32' (FIG. 3), to support structure on the ends of the tub, to be pivotal thereabout. Extending from the conventional piston (not shown) in this cylinder, and out of the other end of the cylinder, is a piston rod 34, 34' respectively. The outer end of each piston rod is pivotally mounted by a pin 35, 35' respectively to one end of a link 38, 38' (FIGS. 1 and 2), with the pinned connection being shown disconnected at 35' in FIGS. 3 and 4 for the purpose of showing the arcuate movement of link 38'. The opposite end of each link 38, 38' is keyed to a shaft 40, 40' respectively. Also keyed to this shaft are radially extending roller arms 42, 42' respectively. Each of these arms 42, 42' is preferably composed of a pair of arms, see, e.g., 42A and 42B (FIG. 8) of arm 42, having one end affixed to a collar 42C around shaft 40. The outer ends of elements 42A and 42B include elongated radial slots 42D (FIG. 7) which receive roller shaft 46, 46' respectively, on which the cam follower rollers 50 and 50' are rotationally mounted. These individual rollers 50 and 50' remain in full engagement with the cam tracks 24 and 24' when actuated. Shaft 46 is mounted in a pair of end supports 48 which are engaged by a pair of threaded adjustment studs 52. The rollers 50 and 50' can be radially adjusted relative to shaft 40, 40' to tighten or loosen the gate closure condition as desired. Specifically, a pair of threaded adjustment studs, e.g., 52 for roller 50 (FIG. 8), mounted in brackets 54 which are straddled by hex nuts 55, can be rotationally turned to radially push or pull the roller into different radial positions in slots 42D. Arms 42 and 42' are mounted to shafts 40 and 40' with a split collar, see, e.g., collar 42C (FIG. 7). This enables easy replacement as necessary. A key between each of the collars and the shaft maintains simultaneous movement thereof, see, e.g., key 43 (FIG. 7).

Opening and closing of the pair of gates 20 and 20', therefore, is achieved by activating the two actuators 30 and 30', which cause pivoting of the corresponding links 38 and 38', which rotate the shafts 40 and 40' to pivot the roller arms 42 and 42' about the axis of shafts 40 and 40', to cause the rollers 50 and 50' to move along the configurated, variable profile cam tracks 24 and 24' which are the stiffening ribs of the gates. The cam rollers 50 and 50' move arcuately between the two positions shown in FIG. 4. When the cam followers are in the innermost position, the gates are fully closed. When they are in the outermost position, the gates are swung downwardly openly to dump the contents of the tub. At the innermost position of the cam follower rollers, they are against a stop which is over-center a few degrees to keep the gates closed even if power is lost to the actuators. When the cam follower rollers move from the first, outer portion of the cam tracks to the second, inner portion of the cam tracks, the gates move more slowly and with greater force to assure full, tight closure. For reasons to be explained hereinafter, it is important that these gates be closed in timed relationship, with gate 20 being slightly ahead of gate 20' during the closing action. To achieve this, the two shafts 40 and 40' are linked together with a pair of cross link control arms, e.g. 60, one at each end of the tub, each having its opposite ends pivotally connected to radial extensions 62 and 62' from the sleeves, e.g., 42C.

Figure 5:
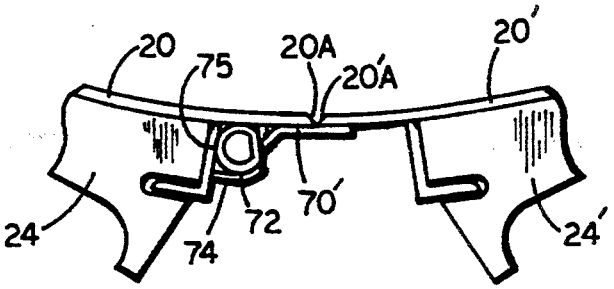
FIG. 5 is a fragmentary, enlarged, end elevational view of the interfitting gates of this invention.

The gates 20 and 20' are dimensioned so that the lower inner edges thereof will closely approach each other, and preferably slightly abut, in the fully closed position as depicted in FIG. 5. The lower inner edges of these two gates are beveled at 20A and 20'A (FIG. 5) so that any residual feed material, or like particulate material, will be squeezed from therebetween up into the tub so as to not inhibit full closure of the gates. A first seal is formed beneath these two gales by having an elongated metal batten plate 70' attached as by welding to gate 20', this plate underlying the long juncture between the two gates, and underlapping gate 20 a small amount. The cooperation of the outer free edge of this batten 70' with an elongated, compressible, resilient tube element 72, e.g. of rubber, forms a second seal between the two gates. This elongated element 72 is supported in a retainer formed by a box-like assembly 74 beneath gate 20. The face of the seal element toward gate 20' is exposed by having an opening in the box retainer, for engagement by batten 70' therewith to form the second seal when the gates are closed. The amount of compression between seal element 72 and batten 70' can be varied with the size of a shim 75 (FIG. 5) inserted in the retainer behind the seal element.

Figure 10:
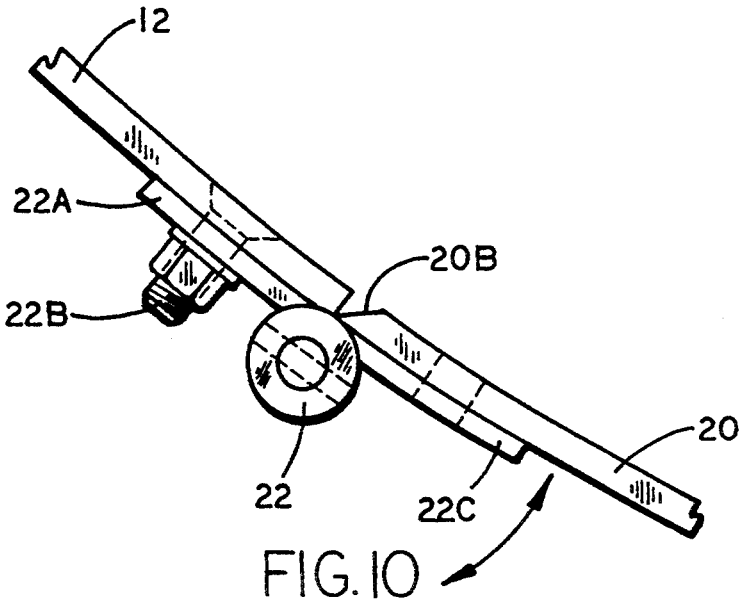
FIG. 10 is an enlarged, fragmentary, end elevational view of the hinge in FIG. 9, mounted on the gate and tub.
Figure 11:
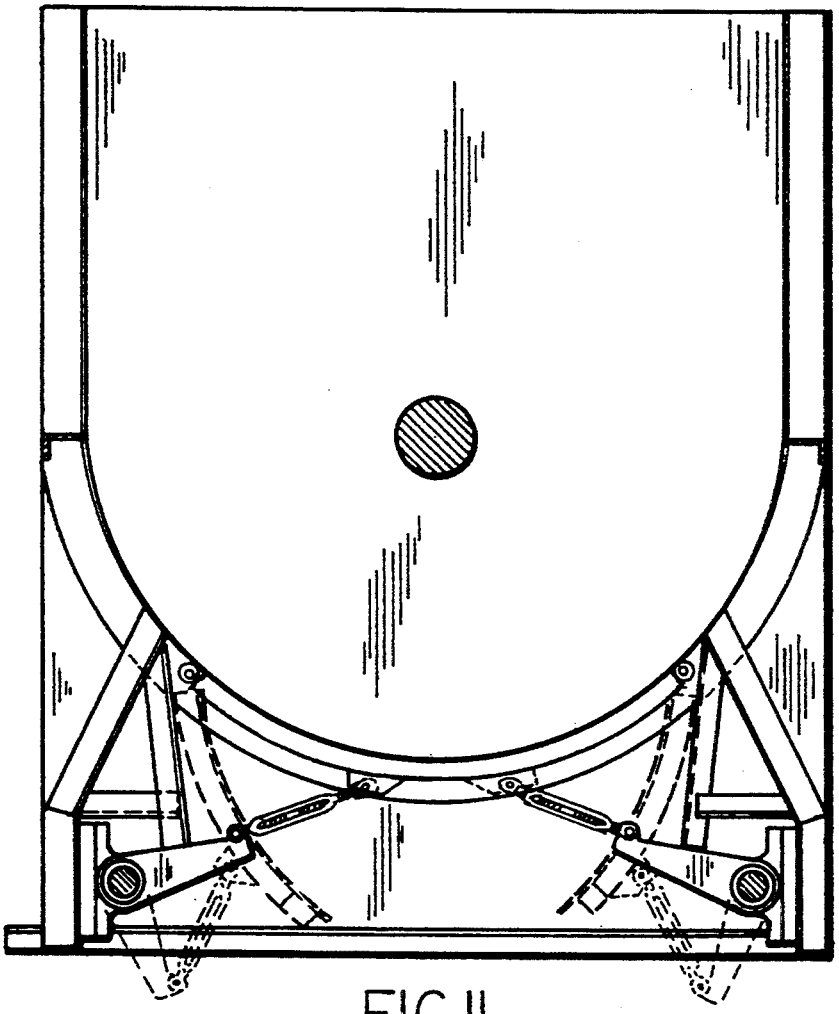
FIG. 11 PRIOR ART
FIG. 11 is an end elevational, fragmentary view of a prior art apparatus.

The upper outer edges of gates 20 and 20' also have beveled edges as depicted, for example, on gate 20 at edge 20B in FIG. 10. Thus, any particulate material tending to remain between the outer edges of these gates and the adjacent edges of the tub opening will be squeezed out of this area into the tub when the gates close.

Figure 9:
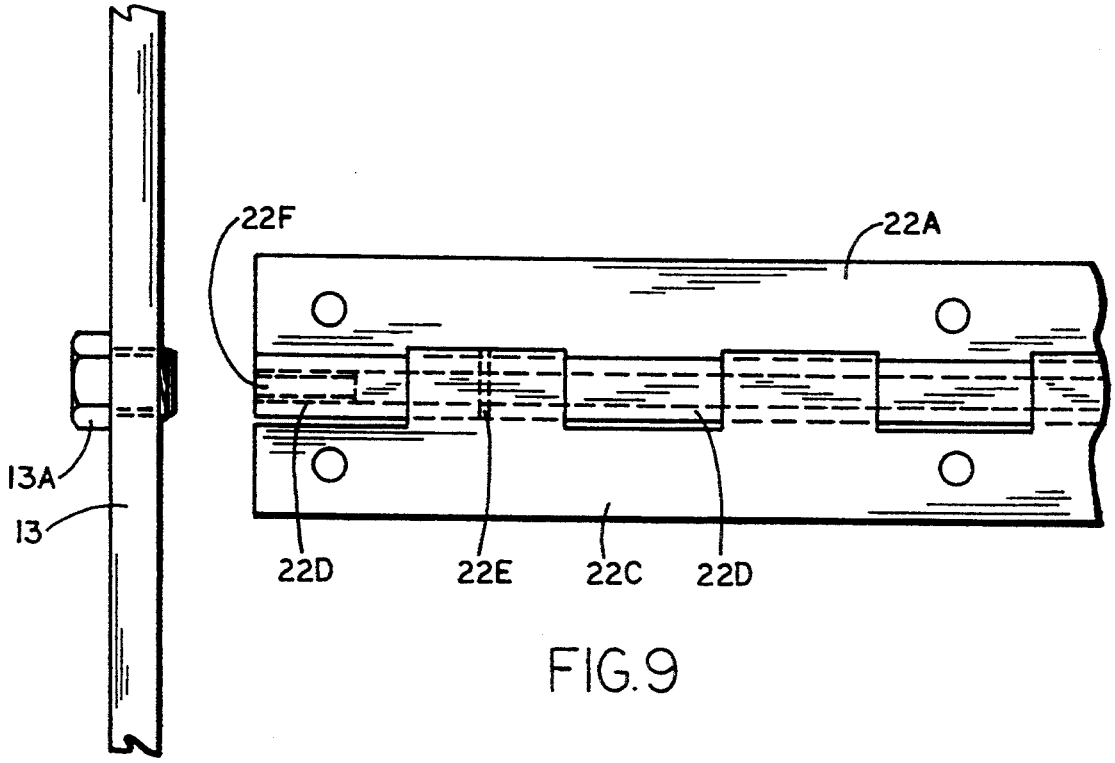
FIG. 9 is a fragmentary, enlarged, bottom view of one of the gate hinges and adjacent end plate.

Hinges 22 and 22' are made in a particular manner to limit wear to two components and also allow rapid replacement of worn components. More specifically, hinge plate 22A is bolted by a series of bolts 22B to the tub 12 while hinge plate 22C is welded to door 20. The hinge plate 22C mounted to door 20 has the hinge pin 22D keyed thereto as by a roll pin 22E (FIG. 9) so that hinge plate 22C will not be worn by action of hinge pin 22D. Rather, all wear is on the hinge pin 22D and the sleeves on the hinge plate 22A. Since hinge plate 22A is bolted in place, it can be readily removed for replacement thereof. Moreover, hinge pin 22D has an end thereof drilled and tapped at 22F so that a threaded puller can be inserted and the pin withdrawn and replaced. Access to this end of the hinge pin is achieved through end plate 13 by having a removable bolt 13A (FIG. 9) in alignment with hinge pin 22D.

It will be evident to those skilled in this art, from the above description and drawings, that this structure has many features and characteristics which are advantageous relative to prior art mechanism. Certain additional advantages not specifically recited may also be apparent. Minor changes in the construction to suit a particular installation can be made without departing from the concept presented. Hence, it is intended that the invention not be limited to the specific preferred embodiment illustrated as exemplary of the invention, but only by the scope of the appended claims and the reasonably equivalent structures to those defined therein.

The embodiments of the invention in which an exclusive property or privilege is claimed are defined as follows:

1. A dump gate assembly for a housing having a bottom opening defined by a pair of elongated edges, comprising:

a pair of dump gates having hinges mounting said dump gates to said housing along said edges, and swingable between a closed, upper condition closing said bottom opening and an open, lower position down away from said bottom opening;

said gates each having a configurated cam track;

a cam follower engageable with each said cam track to follow it when actuated, and a power actuator for each said cam follower arranged to shift said cam followers along the respective said cam tracks and thereby shift said gates to said closed condition.

2. The dump gate assembly in claim 1 wherein each said configurated cam track has a first configurated track portion engaged by the respective said cam follower during the first partial closing movement of said gates, and a second configurated track portion engaged by the respective said cam follower during the final movement of said gates to said closed condition; and said second configurated track portion being curved in a manner to cause said gates to move less distance and with more force per unit movement of said cam follower in comparison with gate movement during said first partial closing movement.

3. The dump gate assembly in claim 2 wherein said second configurated track portion of each cam track is concavely curved and has a stop portion for each said respective cam follower.

4. The dump gate assembly in claim 1 wherein each said cam follower is a roller.

5. The dump gate assembly in claim 1 wherein said gates have stiffening ridges and said cam tracks are formed into said stiffening ridges.

6. The dump gate assembly in claim 2 wherein said configurated cam tracks allow said cam followers to move over-center relative to said gate movement when said gates are in said closed condition, to lock said gates in said closed condition.

7. The dump gate assembly in claim 6 wherein said cam tracks each include a stop to restrain said cam follower from further movement when moved over-center.

8. The dump gate assembly in claim 2 wherein said cam followers are mounted on arms shiftable by said actuators.

9. The dump gate assembly in claim 8 wherein said gates each have two opposite ends, one of said actuators, arms and cam followers being on one end of one gate, and the other of said actuators, arms and cam followers being on the opposite end of the other gate.

10. The dump gate assembly in claim 9 wherein said arms are interconnected with each other by a control shaft to cause timed movement of said cam followers and said gates with respect to each other.

11. The dump gate assembly in claim 4 including an adjustment track and studs for each said roller.

12. The dump gate assembly in claim 1 wherein one of said gates has a bottom batten strip thereon overlapping the other gate when said gates are in said closed condition, to form a first seal, and said other gate has a resilient seal element engageable by said batten strip when said gates are in said closed condition.

13. The dump gate assembly in claim 12 wherein said other gate has a seal retainer retaining said seal element.

14. The dump gate assembly in claim 13 wherein said seal retainer includes means for varying the position of said seal element.

15. The dump gate assembly in claim 1 wherein said hinges include a first hinge element removably attached to said housing, and a second hinge element fixedly attached to said gate.

16. The dump gate assembly in claim 15 wherein said hinges include a removable pin having a tapped end for pin removal by insertion of a threaded puller.

17. The dump gate assembly in claim 15 wherein said hinge elements have a pin therebetween and said pin is keyed to said second hinge element.

18. The dump gate assembly in claim 1 wherein said gates have inner beveled edges which meet when said gates are in said closed condition, to force material from between said edges.

19. The dump gate assembly in claim 1 wherein said gates have outer beveled edges which meet said housing opening edges when said gates are in said closed condition, to force material from between said meeting edges.

20. The dump gate assembly in claim 18 wherein said gates have outer beveled edges which meet said housing opening edges when said gates are in said closed condition, to force material from between said meeting edges.

21. The dump gate assembly in claim 1 wherein said cam followers are mounted on respective radial arms and said radial arms are mounted on and keyed to pivotal shafts with split collars.

* * * * *